US007197910B2

(12) United States Patent
Kodani

(10) Patent No.: US 7,197,910 B2
(45) Date of Patent: Apr. 3, 2007

(54) DIE CUSHION APPARATUS OF A PRESS MACHINE AND SURGE PRESSURE REDUCTION METHOD FOR A DIE CUSHION APPARATUS

(75) Inventor: Shigeki Kodani, Komatsu (JP)

(73) Assignee: Komatsu Ltd., Tokyo (JP)

( * ) Notice: Subject to any disclaimer, the term of this patent is extended or adjusted under 35 U.S.C. 154(b) by 147 days.

(21) Appl. No.: 10/801,552

(22) Filed: Mar. 17, 2004

(65) Prior Publication Data

US 2004/0187546 A1 Sep. 30, 2004

(30) Foreign Application Priority Data

Mar. 28, 2003 (JP) ..... 2003-091873

(51) Int. Cl.
*B21J 9/18* (2006.01)

(52) U.S. Cl. ..... 72/453.13; 72/350

(58) Field of Classification Search ..... 72/350, 72/351, 453.13; 267/119
See application file for complete search history.

(56) References Cited

U.S. PATENT DOCUMENTS 2,007,290 A * 7/1935 Treer ..... 267/119
3,147,722 A * 9/1964 Williamson ..... 72/348
3,910,087 A * 10/1975 Jones ..... 72/63
5,065,606 A * 11/1991 Kadis ..... 72/348
5,966,981 A * 10/1999 Janos et al. ..... 72/350

FOREIGN PATENT DOCUMENTS

| | | |
|---|---|---|
| JP | 64-5711 | 1/1989 |
| JP | 7-47195 | 11/1995 |
| JP | 8-215899 | 8/1996 |
| JP | 11-157629 | 6/1999 |

* cited by examiner

*Primary Examiner*—Lowell A. Larson
*Assistant Examiner*—Teresa M. Bonk
(74) *Attorney, Agent, or Firm*—Wenderoth, Lind & Ponack, L.L.P.

(57) ABSTRACT

In a die cushion apparatus, a pressurizing force acting on a die cushion pad is applied to a first piston of a hydraulic cylinder unit by the operation of a slide, the first piston slides inside a first cylinder and pressure oil in a first hydraulic chamber is pressurized. The first hydraulic chamber is linked to a second hydraulic chamber of a booster cylinder unit via a second check valve, so that the pressure oil of the first hydraulic chamber is pushed out into the second hydraulic chamber. When the pressure of the first hydraulic chamber is applied to a second piston, the second piston slides inside the second cylinder and gas of a gas pressure chamber is compressed, whereby a surge pressure is reduced.

4 Claims, 4 Drawing Sheets

DIE CUSHION APPARATUS OF A PRESS MACHINE AND SURGE PRESSURE REDUCTION METHOD FOR A DIE CUSHION APPARATUS

BACKGROUND OF THE INVENTION

1. Field of the Invention

The present invention relates to a die cushion apparatus of a press machine and to a surge pressure reduction method for a die cushion apparatus, more specifically to a die cushion apparatus of a press machine and to a surge pressure reduction method for a die cushion apparatus in which pressure oil is pressurized with the pressurizing force acting upon a die cushion pad and sealed gas is compressed by this pressure of the pressure oil.

2. Description of the Related Art

A die cushion apparatus has a function of pushing up the work that was fit into the lower mold, following the slide lift. However, the progress attained in the die technology resulted in that the blank holder function (a function of holding the peripheral portion of the work during deep drawing) is requested to be provided with the die cushion, and die cushions are now required to have a large capability, for example, of 300 tons or 400 tons.

In the usual die cushions, the lower surface side is supported by a pneumatic cylinder unit. This pneumatic cylinder unit is composed of a cylinder, a piston accommodated inside the cylinder and connected to the die cushion pad, and a pneumatic chamber. Air set to the prescribed pressure is sealed in the pneumatic chamber. During press operation, the pressure applied from the slide to the bolster acts upon the die cushion pad from the moment the upper mold and lower mold are brought into contact and to the moment the slide reaches the lower dead center. As a result, the die cushion pad and the piston of the pneumatic cylinder unit are moved down and the air sealed in the pneumatic chamber is compressed. Therefore, the movement of the die cushion pad is absorbed by the compression of air in the pneumatic chamber.

However, if the die cushion capacity is increased and the production rate further rises, an excessively large peak pressurizing force is generated at the instant of time the upper mold and lower mold are brought into contact. This peak pressurizing force is called a surge pressure, and a peak value increases in the air with a large compressibility. A variety of problems such as vibrations, noise, cracking of press frame, equipment failure, and low-quality processing of works were associated with such surge pressure. Accordingly, a technology has recently been used by which the die cushion pad was caused to move down immediately prior to the contact of the upper mold and lower mold in order to reduce the surge pressure. Such an operation control of the die cushion pad is called pre-acceleration. A Numerical Control (NC) die cushion shown, for example, in Japanese Examined Utility Model Application No. 7-47195 (column 4, lines 40–48, FIG. 1) is known as an example of the pre-acceleration.

FIG. 4 shows a hydraulic circuit of an NC die cushion. The lower surface of the die cushion pad 2 is supported by both a pneumatic cylinder unit 80 and the hydraulic cylinder unit 70. The hydraulic cylinder unit 70 is composed of a cylinder 71, a piston 72 sliding inside the cylinder 71, and first to third hydraulic chambers 73–75 separated by the piston 72. The piston 72 is connected to the die cushion pad 2 via a rod 76.

A pressure oil from the hydraulic pump is supplied to second and third hydraulic chambers 74, 75. This supply of pressure oil to the second and third hydraulic chambers 74, 75 is controlled by a servo valve unit 90. The servo valve unit 90 is controlled at a timing just before the contact of the upper mold and lower mold, and the pressure oil from the hydraulic pump 3 is supplied to the third hydraulic chamber 75. As a result, a pressure in the downward direction acts upon the piston 72, and the die cushion pad 2 moves down. For this reason, the relative speed of the upper mold and lower mold is decreased. The surge pressure is thus reduced.

In the NC die cushion shown in FIG. 4, supply of pressure oil to the first hydraulic chamber 73 and the discharge of the oil therefrom are controlled with the servo valve unit 94. Because the oil has small compressibility, if the pressure control of the first hydraulic chamber 73 is not conducted with good timing, the piston 72 to which the pressurizing force of the die cushion pad 2 is applied cannot operate and the apparatus is stopped frequently or, in the worst case, the apparatus is damaged.

The following control is also carried out in the NC die cushions.

If the die cushion pad 2 rises from the lower dead center as the slide passes the lower dead center, the work is sometimes deformed. Therefore, the die cushion pad 2 has to be temporarily stopped at the lower dead center. Such an operation control of the die cushion pad 2 is called locking.

In the NC die cushion shown in FIG. 4, the servo valve unit 90 is controlled and the circuit linking the second hydraulic chamber 74 and third hydraulic chamber 75 is closed at the timing when the die cushion pad has reached the lower dead center. As a result, the pressure oil located inside the third hydraulic chamber 75 is sealed. Therefore, even if the piston 72 tries to slide upward under the effect of pressure oil located inside the first hydraulic chamber 73, this operation is prevented by the pressure oil located in the third hydraulic chamber 75.

The servo valve used in the NC die cushion is easily affected by the impurities contained in the pressure oil. A small quantity of impurities mixed with the pressure oil prevent the servo valve from operating normally. Therefore, complicated operations such as maintenance of pressure oil have to be conducted frequently.

FIG. 4 shows a simplified servo valve unit, but actual servo valve units are composed of a large number of hydraulic mechanisms. Problems associated with such a configuration include a complicated piping system, increased cost, and a high malfunction frequency of the die cushion itself.

Furthermore, pressure control has to be carried out with good timing in order to conduct the pre-acceleration and locking effectively, and timing adjustment is a very difficult operation.

SUMMARY OF THE INVENTION

The present invention was made with the foregoing in view, and it is an object of the present invention to provide a die cushion apparatus that has a simple configuration, reduces a surge pressure and is easy to handle.

A die cushion apparatus of a press machine according to a first aspect of the present invention is so constructed that pressure oil is pressurized with a pressurizing force acting upon a die cushion pad, whereby sealed gas is compressed by pressure of the pressure oil thus pressurized.

Further, a die cushion apparatus of a press machine according to a second aspect of the present invention comprises a die cushion pad which is movable up and down according to a pressurizing force applied from outside; a first pressure receiving unit comprising a first accommodation unit, a first sliding member and a first hydraulic chamber, the first sliding member and the first hydraulic chamber being accommodated in the first accommodation unit, wherein the first sliding member is caused to slide by a pressurizing force acting upon the die cushion pad to pressurize pressure oil in the first hydraulic chamber; and a second pressure receiving unit comprising a second accommodation unit, a second sliding member, a second hydraulic chamber and a gas pressure chamber, the second hydraulic chamber and the gas pressure chamber being separated by the second sliding member, the second sliding member, the second hydraulic chamber and the gas pressure chamber being accommodated in the second accommodation unit, wherein the second sliding member is caused to slide by a pressure of the first hydraulic chamber to compress gas in the gas pressure chamber.

The first and second aspects of the invention will be described below with reference to FIG. 1.

If a pressurizing force acting upon a die cushion pad 2 is applied to a first piston (first sliding member) 52 of a hydraulic cylinder unit (first pressure receiving unit) 5, following the operation of a slide (not shown in the figure), then the first piston 52 slides inside a first cylinder 51 and the pressure oil in a first hydraulic chamber 53 is pressurized. Because the first hydraulic chamber 53 is linked to a second hydraulic chamber 63 of a booster cylinder unit (second pressure receiving unit) 6 via a second check valve 9, the pressure oil present in the first hydraulic chamber 53 is pushed out into the second hydraulic chamber 63. Thus, if the pressure of the first hydraulic chamber 53 is applied to a second piston (second sliding member) 62, then the second piston 62 will slide inside a second cylinder (second accommodating unit) 61 and the gas present in a gas pressure chamber 64 will be compressed.

With the first and second aspects of the invention, the pressurizing force of the die cushion pad is directly applied to the working oil which has a compressibility sufficiently lower than that of the air. As a result, the surge pressure can be reduced by comparison with the case in which the pressurizing force of the die cushion pad is directly applied to the air. This is realized by a configuration employing the hydraulic cylinder unit and booster cylinder unit. With such a configuration, the movement of the die cushion pad can be absorbed by compression of air in the booster cylinder, and the instantaneous surge pressure can be absorbed by compression of the working oil. Therefore, it is not necessary to use an expensive servo valve unit. As a result, the configuration of the hydraulic apparatus can be simplified and the production cost can be reduced.

Furthermore, with the first and second aspects of the invention in which the oil pressure of the booster cylinder unit is converted into the gas pressure, it is not necessary to control the oil pressure, and the die cushion apparatus itself can be easily handled.

A die cushion apparatus of a press machine according to a third aspect of the present invention comprises a die cushion pad which is movable up and down according to a pressurizing force applied from outside; a first pressure receiving unit comprising a first accommodation unit, a first sliding member and a first hydraulic chamber, the first sliding member and the first hydraulic chamber being accommodated in the first accommodation unit, wherein the first sliding member is caused to slide by a pressurizing force acting upon the die cushion pad to pressurize pressure oil in the first hydraulic chamber; and a second pressure receiving unit comprising a second accommodation unit, a second sliding member, a second hydraulic chamber and a gas pressure chamber, the second hydraulic chamber and the gas pressure chamber being separated by the second sliding member, the second sliding member, the second hydraulic chamber and the gas pressure chamber being accommodated in the second accommodation unit, wherein the second sliding member is caused to slide by a pressure of the first hydraulic chamber to compress gas in the gas pressure chamber; a first check valve that prevents a flow of the pressure oil from the first hydraulic chamber to a hydraulic pump; a second check valve that prevents a flow of the pressure oil from the second hydraulic chamber to the first hydraulic chamber; and an opening/closing unit that closes a flow of the pressure oil from the second hydraulic chamber to a hydraulic tank when the second sliding member slides in the direction of compressing the gas in the gas pressure chamber, and opens the flow of the pressure oil from the second hydraulic chamber to the hydraulic tank when the second sliding member slides in the direction of compressing the pressure oil in the second hydraulic chamber.

The third aspect of the present invention will be described below with reference to FIG. 1.

If a pressurizing force acting upon the die cushion pad 2 is applied to the first piston (first sliding member) 52 of the hydraulic cylinder unit (first pressure-receiving unit) 5, following the operation of a slide (not shown in the figure), then the first piston 52 slides inside the first cylinder 51 and the pressure oil in the first hydraulic chamber 53 is pressurized. Because the first hydraulic chamber 53 is linked to the second hydraulic chamber 63 of the booster cylinder unit (second pressure receiving unit) 6 via the second check valve 9, the pressure oil present in the first hydraulic chamber 53 is pushed out into the second hydraulic chamber 63. Thus, if the pressure of the first hydraulic chamber 53 is applied to the second piston (second sliding member) 62, then the second piston 62 will slide inside the second cylinder (second accommodating unit) 61 and the gas present in a gas pressure chamber 64 will be compressed.

When a pressurizing force acting from the slide upon the die cushion pad 2 is generated, the pressure of the pressure oil in the first hydraulic chamber 53 is higher than that of the pressure oil supplied from the hydraulic pump 3. Therefore, the first check valve 8 is closed. When no pressurizing force acting from the slide upon the die cushion pad 2 is generated, the first check valve is open and the pressure oil is supplied from the hydraulic pump 3 and accumulator 4 to the first hydraulic chamber 53.

If the pressurizing force acting upon the die cushion pad 2 disappears, then the second piston 62 subjected to the restoration force of the gas present in the gas pressure chamber tries to slide toward the second hydraulic chamber 63. However, because the pressure oil present in the second hydraulic chamber 53 does not flow into the first hydraulic chamber 63 due to the operation of the second check valve 9, the oil located in the second hydraulic chamber 63 has nowhere to go. Accordingly, a logic valve (opening/closing unit) 10 is opened and the pressure oil present in the second hydraulic chamber 63 is discharged into the hydraulic tank 11.

The third aspect of the present invention can provide the effect same as the first and second aspects of the invention.

In addition, the third aspect of the present invention makes it possible to obtain the following effect. In the conventional die cushion apparatuses, the hydraulic cylinder 5 had to be provided with a locking function matching the performance of the die cushion. However, in accordance with the third aspect of the present invention, the restoration force of the gas pressure chamber 64 is not applied to the die cushion pad 2 when the die cushion pad 2 rises. Therefore, locking of the entire die cushion can be carried out only with the locking member 81 of the hydraulic cylinder 80. This is realized by the configuration comprising the second check valve and logic valve. Therefore, it is not necessary to use a servo valve unit that has been employed for conducting locking control in the conventional apparatuses. Because of this, too, the configuration of the hydraulic apparatus can be simplified and the production cost can be reduced.

A die cushion apparatus of a press machine according to a fourth aspect of the present invention is so constructed that in the die cushion apparatus according to the third aspect of the present invention, opening degree of the opening/closing unit decreases according to sliding of the second sliding member in the direction of compressing the pressure oil in the second hydraulic chamber.

In accordance with the fourth aspect of the present invention, when the second piston 62 slides toward the second hydraulic chamber 63, as the second piston 62 approaches the end portion of the second cylinder 61, the logic valve 10*a* or 10*b* is closed and the opening degree of the hydraulic channel is reduced. As a result, the impact generated when the second piston 62 is brought into contact with the end portion of the second cylinder 61 is moderated.

A die cushion apparatus of a press machine according to a fifth aspect of the present invention is so constructed that in the die cushion apparatus according to the third aspect of the present invention, a first rod connected to the die cushion pad and a second rod connected to the first sliding member are further provided, and when the die cushion pad is moved down, the first rod and the second rod are abutted and a pressurizing force acting upon the die cushion pad is applied to the first sliding member.

In the fifth aspect of the present invention, when the die cushion pad 2 is lowered, the first rod 21 connected to the die cushion pad 2 and the second rod 54 connected to the first piston 52 are usually brought into contact. When the die cushion pad 2 is lifted, if the difference in working speed occurs between the pneumatic cylinder unit 80 and hydraulic cylinder unit 5, the first rod 21 and second rod 54 are separated. As a result, when the die cushion pad 2 reaches to top dead center, the pressure of the hydraulic cylinder 5 does not act upon the die cushion pad 2. Therefore, the impact occurring when the die cushion pad 2 reaches the top dead center is sufficiently moderated by a damper 82 of a pneumatic cylinder unit 80.

A method of reducing a surge pressure generated in a die cushion apparatus of a press machine according to a sixth aspect of the present invention comprises a pressure oil pressurizing step of applying a pressurizing force to act upon a die cushion pad of the die cushion apparatus to pressure oil; and a gas pressurizing step of applying a pressure of the pressure oil pressurized in the pressure oil pressurizing step to a gas.

The sixth aspect of the present invention is obtained by converting the first and second aspects of the invention into an invention relating to a method.

BRIEF DESCRIPTION OF THE DRAWINGS

In the accompanying drawings.

DESCRIPTION OF THE PREFERRED EMBODIMENTS

Figure 1:
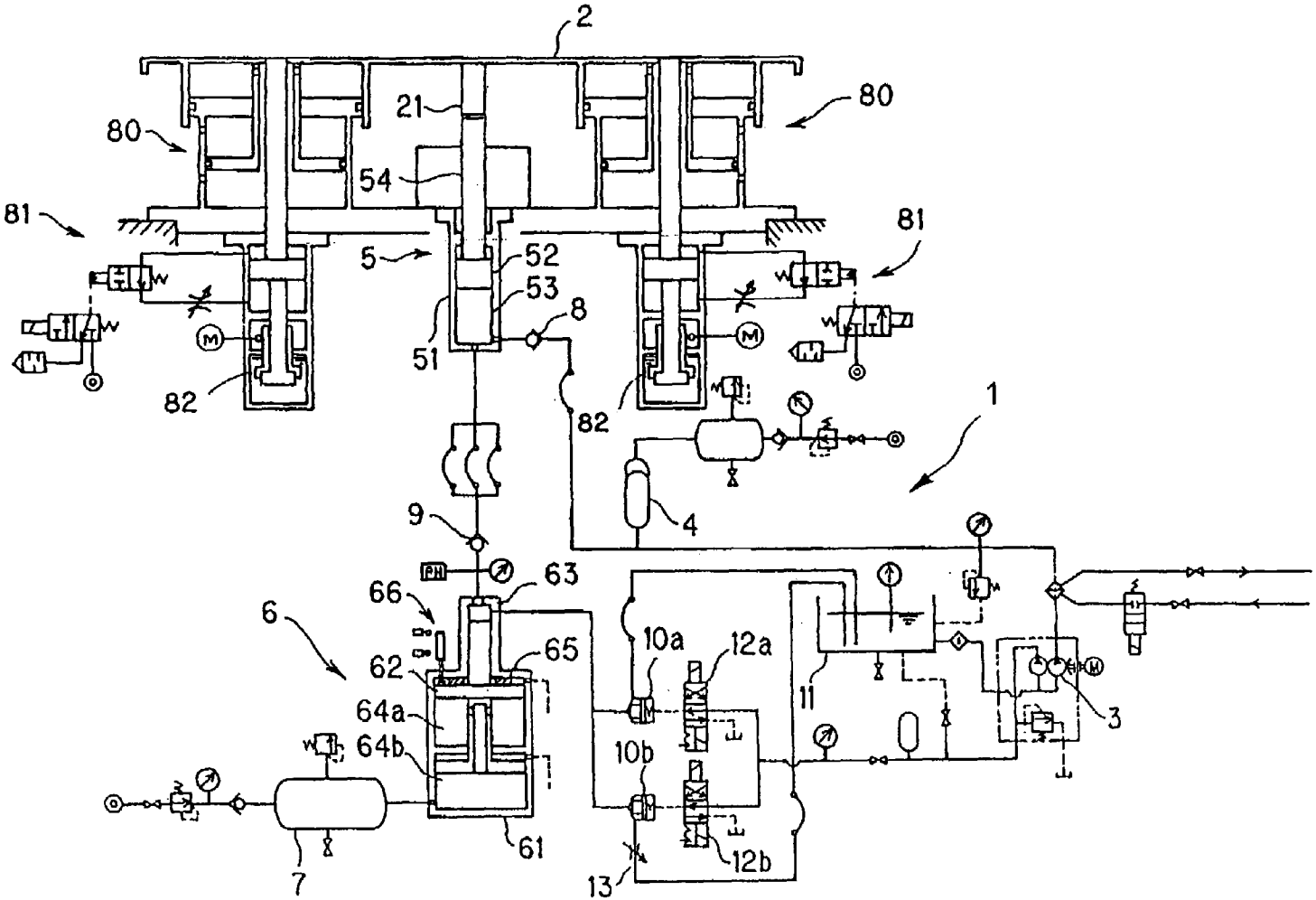
FIG. 1 shows a hydraulic circuit of the die cushion apparatus in accordance with embodiment of the present invention.
Figure 2:
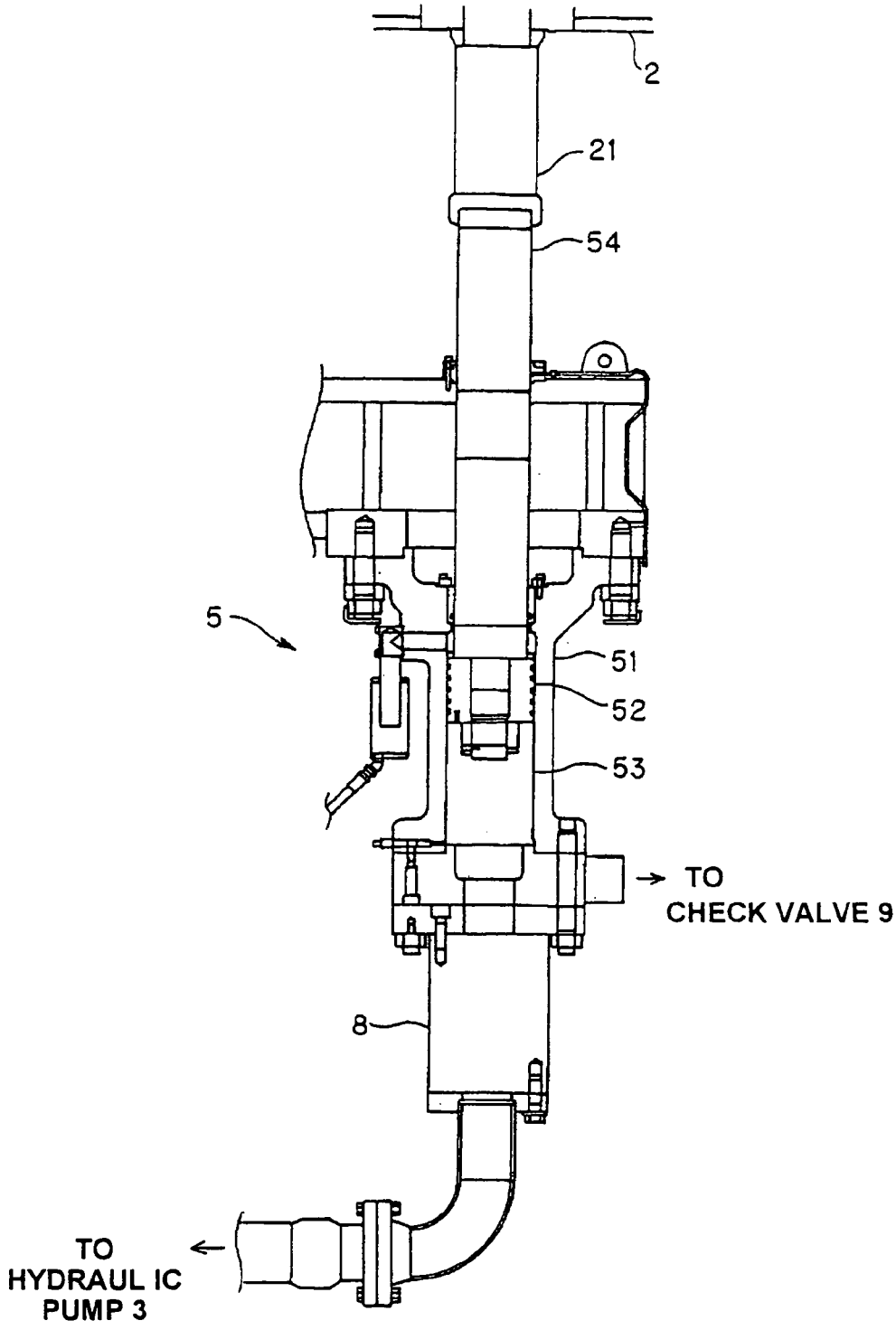
FIG. 2 is a partial cross-sectional view of a hydraulic cylinder unit.
Figure 3:
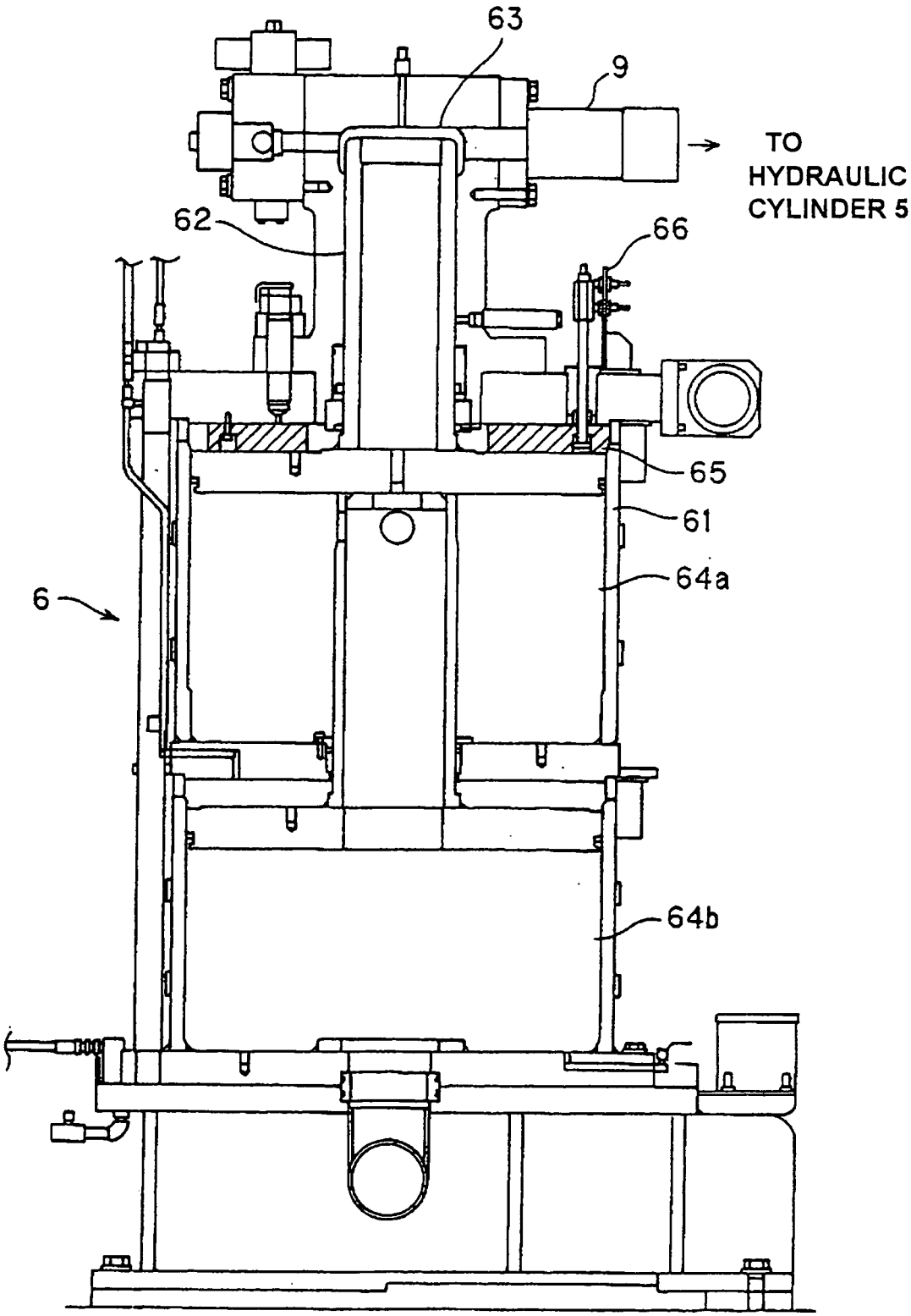
FIG. 3 is a partial cross-sectional view of a booster cylinder.
Figure 4:
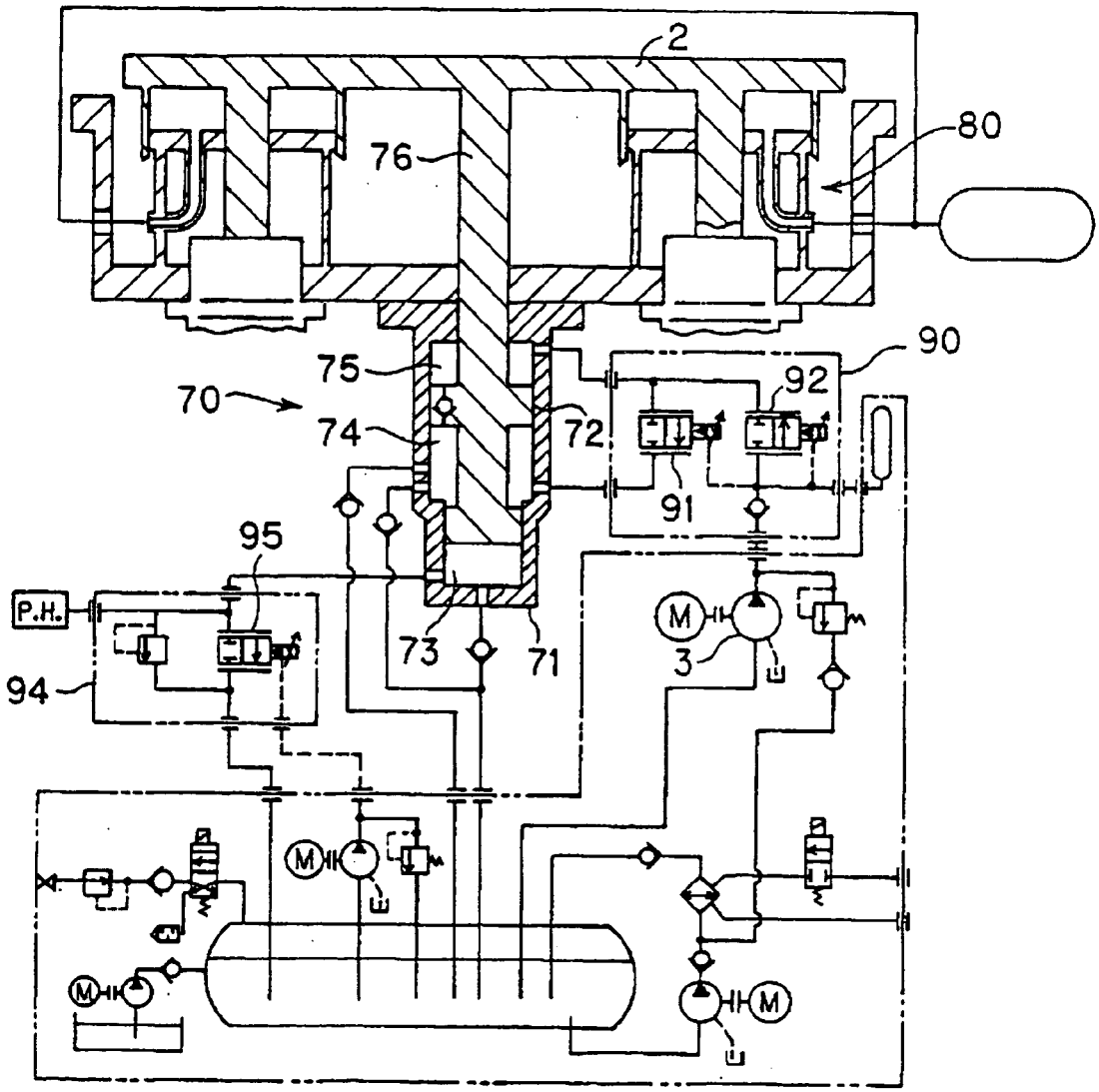
FIG. 4 (PRIOR ART)
FIG. 4 shows a hydraulic circuit of a conventional NC die cushion.

Embodiment of the die cushion apparatus in accordance with the present invention will be described hereinbelow with reference to the accompanying drawings.

A die cushion pad 2 is supported on the lower surface side thereof by a hydraulic cylinder unit 5 together with a pneumatic cylinder unit 80. Because the pneumatic cylinder unit 80 is identical to that used in the conventional die cushion, the explanation thereof is herein omitted. A first rod 21 is connected to the lower surface of the die cushion pad 2, and the pressurizing force acting when the die cushion pad 2 is lowered is applied to a hydraulic cylinder unit 5 via the first rod 21.

A hydraulic pump 3 discharges the pressure oil under a constant pressure. An accumulator 4 serves to compensate the insufficient supply of the pressure oil discharged from the hydraulic pump 3 and to prevent pressure pulsations. A first check valve 8 is connected to the oil channel so as to allow the pressure oil to flow in the direction from the hydraulic pump 3 to the hydraulic cylinder 5 and to prevent the pressure oil from flowing in the direction from the hydraulic cylinder unit 5 to the hydraulic pump 3.

The hydraulic cylinder unit 5 comprises a first cylinder 51, a first piston 52 accommodated inside the first cylinder 51, and a first hydraulic chamber 53. The pressure oil discharged from the hydraulic pump 3 is supplied to the first hydraulic chamber 53. A second rod 54 is connected to the first piston 52 on the side of the die cushion pad 2. The second rod 54 is usually abutted against the first rod 21, but when the difference between the actuation speed occurs between the pneumatic cylinder unit 80 and hydraulic cylinder unit 5 as the die cushion pad 2 rises, the second rod 54 separates from the first rod 21. The first piston 52 slides inside the first cylinder 51 under the effect of the pressure in the first hydraulic chamber 53 and the pushing force of the second rod 54.

The second check valve 9 is connected to the oil channel so as to allow the pressure oil to flow in the direction from the hydraulic cylinder unit 5 to the booster and to prevent the pressure oil from flowing in the direction from the booster cylinder unit 6 to the hydraulic cylinder unit 5.

The booster cylinder unit 6 comprises a second cylinder 61, a second piston 62 accommodated inside the second cylinder 61, a second hydraulic chamber 63 separated by the second piston 62, and a gas pressure chamber 64. The second hydraulic chamber 63 and the first hydraulic chamber 53 are linked together via a second check valve 9. The gas pressure chamber 64 is connected to an external gas pressure tank 7. The pressure in the gas pressure chamber 64 can be adjusted by adjusting the pressure of the gas pressure tank 7. Adjusting the gas pressure determines the pressure of pressure oil generated when the die cushion pad 2 moves down. Further, the gas sealed in the gas pressure chamber is air, but other gases may be also used. When the compressibility of the other gas is different from that of the air, this issue should be taken into account. The second piston 62 slides inside the second cylinder 61 under the pressure of the second hydraulic chamber 63 or the pressure of the gas pressure chamber 64.

In the present embodiment, gas pressure chambers 64*a*, 64*b* of a two-stage system are provided. With such a multistage gas pressure chamber 64, the pressure receiving surface area of the gas pressure chamber 64 can be increased even when a small-diameter cylinder is used.

When the second hydraulic chamber 63 is at a minimum capacity and the gas pressure chamber 64 is at a maximum capacity, the second piston 62 is abutted against a buffer member 65 provided inside the second cylinder 61. The buffer member 65 is formed from a typical elastic member, for example, a polyurethane or spring and is provided to moderate the impacts occurring when the second piston 62 reaches the end portion of the second cylinder 61. Furthermore, a stroke sensor 66 for detecting a stroke of the second piston 62 is provided in the booster cylinder unit 6.

The logic valve 10 opens and closes the flow of pressure oil discharged from the second hydraulic chamber 63 of the booster cylinder unit 6 into the tank 11. Opening and closing of the logic valve 10 are controlled by the electromagnetic valve 12. Further, in the present embodiment, two logic valves 10*a*, 10*b*, an electromagnetic valves 12*a*, 12*b*, and a variable throttle 13 are provided. Providing a plurality of logic valves 10, controlling the opening and closing thereof, and also controlling the flow rate of the variable throttle 13 makes it possible to adjust the quantity of the pressure oil discharged from second hydraulic chamber 63.

The operation of the die cushion apparatus 1 will be described below. Usually, a bolster or the like is inserted between the slide and the die cushion pad, but the explanation thereof is herein omitted.

First, the operation of the die cushion device 1 following the downward movement of the slide will be explained.

If the slide (not shown in the figure) moves down and the upper mold and lower mold are brought into contact with each other, the pressurizing force of the slide acts upon the die cushion pad 2. This pressurizing force is applied to the first piston 52 via the first rod 21 and second rod 54, and the first piston 52 slides toward the first hydraulic chamber 53. As a result, the pressure oil present in the first hydraulic chamber 53 is pressurized and the pressure inside the first hydraulic chamber 53 rises. The instantaneous surge pressure is absorbed by the compression of the pressure oil in the first hydraulic chamber 53. At this time, the pressure in the first hydraulic chamber 53 becomes higher that the discharge pressure of the hydraulic pump 3, but the flow of the pressure oil from the first hydraulic chamber 53 to the hydraulic pump 3 is prevented by the first check valve 8.

The pressure oil of the first hydraulic chamber 53 is pushed out into the second pressure chamber 63 through the second check valve 9. Because the gas has a compressibility higher than that of the pressure oil, the second piston 62 that received the oil pressure overcomes the pushing force crated by the gas pressure and slides toward the gas pressure chamber 64. As a result, the gas in the gas pressure chamber 64 is compressed as the pressure thereof is raised. Therefore, the movement of the first piston of the first hydraulic chamber 53 is absorbed by the compression of the gas of the gas pressure chamber 64.

The operation of the die cushion apparatus 1 following the upward movement of the slide will be described below.

If the slide rises through the lower dead center, the pressurizing force of the slide acting upon the die cushion pad 2 is eliminated. As a result, the pressure of the first hydraulic chamber 53 drops.

In the booster cylinder unit 6, a restoration force of the gas is generated in the gas pressure chamber 64, and under the effect of this restoration force the second piston 62 tries to slide toward the second hydraulic chamber 63. However, because the flow of the pressure oil from the second hydraulic chamber 63 to the first hydraulic chamber 53 is prevented by the second check valve 9, the pressure oil of the second hydraulic chamber 63 has nowhere to move. Here, an open command is outputted to the electromagnetic valves 12*a*, 12*b*, and the closed logic valves 10*a*, 10*b* are opened. Therefore, the pressure oil of the second hydraulic chamber 63 is discharged into the hydraulic tank 11 through the logic valves 10*a*, 10*b*, and the second piston 62 can slide toward the second hydraulic chamber 63.

The position of the second piston 62 is detected by the stroke sensor 66. If the second piston 62 approaches the end portion of the second cylinder 61, a logic valve close command is outputted from the stroke sensor 66. Based on this command, the electromagnetic valve 12*a* is closed and the logic valve 10*a* is closed. As a result, only the logic valve 10*b* becomes open and the pressure oil of the second hydraulic chamber 63 is discharged into the hydraulic tank 11 through the logic valve 10*b* and variable throttle 13. Therefore, the flow rate of the pressure oil discharged from the second hydraulic chamber 63 decreases. As a result, the speed of the second piston 62 sliding inside the second cylinder 61 decreases and the impact applied to the buffer member 65 is reduced.

If the locking member 81 of the pneumatic cylinder unit 80 is locked at the moment of time when the slide passes through the lower dead center and starts rising, the die cushion pad 2 in theory has to stop in the lower dead center. However, in reality, because the effects of compression of the working oil inside the locking member 81 and extension of the die cushion rod occur, the die cushion pad 2 stops in a position somewhat above the lower dead center.

During locking the volume of the pressure oil inside the first hydraulic chamber 53 is small. Moreover, because the die cushion pad 2 somewhat rises from the lower dead center, as described hereinabove, the pressure of the pressure oil inside the first hydraulic chamber 53 drops significantly with respect to the pressure attained when the die cushion pad 2 is in the lower dead center. Therefore, even though the pressure of the first hydraulic chamber 53 acts upon the die cushion pad 2, the load of the locking member 81 of the pneumatic cylinder unit 80 does not increase significantly.

If locking of the locking member 81 is released, the die cushion pad 2 rises under the effect of the restoration force of the air pressure of the pneumatic cylinder unit 80. On the other hand, the pressure oil from the hydraulic pump 3 and accumulator 4 is supplied to the first hydraulic chamber 53 of the hydraulic control unit 5, and the pressure of the pressure oil inside the first hydraulic chamber 53 gradually rises. However, the actuation speed of the hydraulic control unit 5 is lower than that of the pneumatic control unit 80. In other words, the lift speed of the second rod 54 is less than the lift speed of the first rod 21. As a result, the first rod 21 and second rod 54 are separated, and after the die cushion pad 2 reaches the upper dead center, the first rod 21 and second rod 25 are brought into contact again. Because the first rod 21 and second rod 54 are thus separated, when the die cushion pad 2 reaches the upper dead center, the pressure of the hydraulic control unit 5 does not act upon the die cushion pad 2. A damper member 82 using the working oil is provided in the pneumatic control unit 80 to moderate the impact occurring when the die cushion pad 2 reaches the upper dead center, but a load applied to the damper member 82 is not increased due to the extension of the second rod 54.

In accordance with the present invention, a pressurizing force acting upon the die cushion pad is applied to the pressure oil in the hydraulic chamber, and the pressure of the pressure oil of the hydraulic chamber is applied to the gas in the gas chamber, thereby reducing the surge pressure. Therefore, the die cushion apparatus acting in the above-described manner may be also constituted by using other devices, without being limited to the above-described embodiment.

In the above-described embodiment, a pressurizing force of the die cushion pad is directly applied to a working fluid which has a compressibility much lower than that of the air. Therefore, the surge pressure is reduced by comparison with the case in which the pressurizing force of the die cushion pad is directly applied to the air. This is realized by the configuration comprising the hydraulic cylinder unit and the booster cylinder unit. With such a configuration, the movement of the die cushion pad can be absorbed by the compression of air in the booster cylinder unit, and the instantaneous surge pressure can be absorbed by the compression of working oil. Therefore, it is not necessary to use an expensive servo valve unit. As a result, the configuration of the hydraulic apparatus can be simplified and the production cost can be reduced.

Furthermore, in the above-described embodiment, because the oil pressure is converted into the gas pressure in the booster cylinder unit, it is not necessary to conduct pressure control of the oil pressure and the die cushion apparatus itself can be easily handled.

Moreover, in the above-described embodiment, the restoration force of the gas pressure chamber 64 is not applied to the die cushion pad 2 when the die cushion pad 2 rises. Therefore, locking of the entire die cushion can be conducted only with the locking means 81 of the pneumatic cylinder 80. This is realized by the configuration comprising the second check valve and logic valve. Therefore, it is not necessary to use a servo valve unit that has been employed for conducting locking control in the conventional apparatuses. Because of this, too, the configuration of the hydraulic apparatus can be simplified and the production cost can be reduced.

What is claimed is:

1. A die cushion apparatus of a press machine, comprising:

a die cushion pad which is movable up and down according to a pressurizing force externally applied to the die cushion pad;

a first pressure receiving unit comprising a first accommodation unit, a first sliding member and a first hydraulic chamber, the first sliding member being slidably received in the first accommodation unit so as to define the first hydraulic chamber, wherein the first sliding member is caused to slide by a pressurizing force acting upon the die cushion pad to thereby pressurize oil in the first hydraulic chamber; and a second pressure receiving unit comprising a second accommodation unit, a second sliding member, a second hydraulic chamber and a gas pressure chamber, the second sliding member being disposed between the second hydraulic chamber and the gas pressure chamber, only oil pressure and gas pressure acting on the second sliding member, the second sliding member being slidably received in the second accommodation unit so as to define the second hydraulic chamber and the gas pressure chamber, wherein the second sliding member is caused to slide by a pressure of the first hydraulic chamber to thereby compress gas in the gas pressure chamber.

2. A die cushion apparatus of a press machine, comprising:

a die cushion pad which is movable up and down according to a pressurizing force externally applied to the die cushion pad;

a first pressure receiving unit comprising a first accommodation unit, a first sliding member and a first hydraulic chamber, the first sliding member being slidably received in the first accommodation unit so as to define the first hydraulic chamber, wherein the first sliding member is caused to slide by a pressurizing force acting upon the die cushion pad to thereby pressurize oil in the first hydraulic chamber; and a second pressure receiving unit comprising a second accommodation unit, a second sliding member, a second hydraulic chamber and a gas pressure chamber, the second sliding member being disposed between the second hydraulic chamber and the gas pressure chamber, only oil pressure and gas pressure acting on the second sliding member, the second sliding member being slidably received in the second accommodation unit so as to define the second hydraulic chamber and the gas pressure chamber, wherein the second sliding member is caused to slide by a pressure of the first hydraulic chamber to thereby compress gas in the gas pressure chamber;

a hydraulic pump that supplies oil to the first hydraulic chamber;

a first check valve that prevents a flow of the pressurized oil from the first hydraulic chamber to the hydraulic pump;

a second check valve that prevents a flow of the pressurized oil from the second hydraulic chamber to the first hydraulic chamber; and an opening/closing unit that closes a flow of the pressurized oil from the second hydraulic chamber to a hydraulic tank when the second sliding member slides in the direction of compressing the gas in the gas pressure chamber, and opens the flow of the pressurized oil from the second hydraulic chamber to the hydraulic tank when the second sliding member slides in the direction of compressing the pressurized oil in the second hydraulic chamber.

3. The die cushion apparatus according to claim 2, wherein opening degree of the opening/closing unit decreases according to sliding of the second sliding member in the direction of compressing the pressurized oil in the second hydraulic chamber.

4. The die cushion apparatus according to claim 2, further comprising a first rod connected to the die cushion pad and a second rod connected to the first sliding member, wherein the first and second rods are structured and arranged such that when the die cushion pad is moved down, the first rod and the second rod are abutted and a pressurizing force acting upon the die cushion pad is applied to the first sliding member.

* * * * *